US006778798B2

(12) United States Patent
Kitahara

(10) Patent No.: US 6,778,798 B2
(45) Date of Patent: Aug. 17, 2004

(54) ROTATING FORCE TRANSMITTING APPARATUS AND IMAGE FORMING APPARATUS EQUIPPED WITH THE SAME

(75) Inventor: Makoto Kitahara, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 91 days.

(21) Appl. No.: 10/044,938

(22) Filed: Jan. 15, 2002

(65) Prior Publication Data

US 2002/0098014 A1 Jul. 25, 2002

(30) Foreign Application Priority Data

Jan. 19, 2001 (JP) ..... 2001-011211

(51) Int. Cl.[7] ..... G03G 15/01
(52) U.S. Cl. ..... 399/228; 192/48.92
(58) Field of Search ..... 399/228, 107, 399/119, 167, 222; 192/48.8, 48.9, 48.91, 48.92, 48.3, 48.4, 48.1

(56) References Cited

U.S. PATENT DOCUMENTS 3,832,914 A * 9/1974 Pinfield ..... 74/810.1
4,458,796 A * 7/1984 Nitanda et al. ..... 192/51
4,789,259 A * 12/1988 Katayanagi ..... 400/624
5,099,278 A * 3/1992 Sato ..... 399/75
5,148,220 A * 9/1992 Hilbert et al. ..... 399/228
5,585,898 A * 12/1996 Fujii ..... 399/228
5,708,345 A * 1/1998 Kramer et al. ..... 318/696
5,828,934 A * 10/1998 Tamura et al. ..... 399/228
6,343,681 B1 * 2/2002 Aoki ..... 192/35
6,499,576 B2 * 12/2002 Wafler ..... 192/48.92

FOREIGN PATENT DOCUMENTS

JP 06003945 A * 1/1994 ..... G03G/15/08
JP 08277042 A * 10/1996 ..... B65H/3/06
JP 2000250315 A * 9/2000 ..... G03G/15/08

* cited by examiner

*Primary Examiner*—Robert Beatty
(74) *Attorney, Agent, or Firm*—Fitzpatrick, Cella, Harper & Scinto

(57) ABSTRACT

A rotating force transmitting apparatus includes: a first and a second transmitting devices for transmitting rotating forces to a first and a second rotary members, wherein the first and the second transmitting devices include a first and a second clutches for intermittently transmitting the rotating forces; a common driving device for imparting the rotating forces to the first and the second transmitting devices, wherein the second clutch can be switched from the turned-off state thereof to the turned-on state thereof for rotating the second rotary member when the first rotary member is rotating with the first clutch being turned on; and a permitting device for permitting the transmission of a rotating force only in a normal rotational direction of the driving device to the first transmitting device.

9 Claims, 9 Drawing Sheets

ROTATING FORCE TRANSMITTING APPARATUS AND IMAGE FORMING APPARATUS EQUIPPED WITH THE SAME

BACKGROUND OF THE INVENTION

1. Field of the Invention

The present invention relates to a rotating force transmitting apparatus for transmitting a rotating force and an image forming apparatus such as a copying machine, a printer, a facsimile machine, and the like that is equipped with the rotating force transmitting apparatus and employs an electrophotographic process, an electrostatic recording process or the like.

2. Description of Related Art

The principal part of a full color electrostatic copying machine being an example of an image forming apparatus equipped with a rotating force transmitting apparatus will be described.

The full color electrostatic copying machine records an image having a plurality of colors on a recording medium by means of a digital image printer portion (hereinafter referred to as a "printer portion") on the basis of image information from a color image reader portion (hereinafter referred to as a "reader portion") for reading the image information on an original.

As shown in FIG. 5, in the printer portion, a pre-exposure lamp 11, a corona charger 2, a laser exposure optical system (not shown), a Y-developing unit 4*y*, a C-developing unit 4*c*, an M-developing unit 4*m* and a Bk-developing unit 4Bk being four developing devices for different colors, means 13 for detecting a quantity of light on the photosensitive drum 1, a transferring apparatus (not shown), a cleaning device 6 and the like are disposed around the photosensitive drum 1 being a latent image bearing member. The Y-developing unit 4*y* is a developing unit for yellow. The C-developing unit 4*c* is a developing unit for cyan. The M-developing unit 4*m* is a developing unit for magenta. The Bk-developing unit 4Bk is a developing unit for black.

When an image is formed by the printer portion, the charger 2 uniformly charges the photosensitive drum 1 after the photosensitive drum 1 has rotated in the direction indicated by the arrow to eliminate residual charges on the outer periphery of the photosensitive dram 1 with the pre-exposure lamp 11. Then, light images E are irradiated on the photosensitive drum 1 so that latent images of respective separated colors of the light images E are formed on the photosensitive drum 1.

Next, the latent images on the photosensitive drum 1 are developed by the operations of the developing units 4*y*, 4*c*, 4*m* and 4Bk corresponding to each separated color, and the images of toner being a powder developer having a base composed of a resin and a pigment are formed on the photosensitive drum 1. Incidentally, the developing units 4*y*, 4*c*, 4*m* and 4Bk are configured to approach the photosensitive drum 1 alternatively correspondingly to each separated color by the operations of respective eccentric cams 24*y*, 24*c*, 24*m* and 24Bk.

On the other hand, a recording material being a recording medium contained in a recording-material cassette (not shown) is fed to a transferring portion formed between the photosensitive drum 1 and the transferring apparatus (not shown) by the conveying system of the electrostatic copying machine, and the toner images on the photosensitive drum 1 are transferred on the recording material by the transferring apparatus. After that, the recording material on which the color image is formed is delivered to the outside.

The rotating force transmitting apparatus 100 for rotating each of the developing units 4*y*, 4*c*, 4*m* and 4Bk for each color will be described.

FIG. 6 is an expanded view of the rotating force transmitting apparatus 100. A rotating force from a drive motor (not shown) is transmitted to an input pulley 102, an input shaft 103 and a distributing gear 104 by a timing belt 101. The distributing gear 104 engages with an M-clutch gear 109*m*, a C-clutch gear 109*c* and idler gears 105 and 107. A rotating force from the idler gear 105 is transmitted to a Bk-clutch gear 109Bk through the idler gear 106, and a rotating force form the idler gear 107 is transmitted to a Y-clutch gear 109*y* through the idler gear 108.

Now, when an M-clutch 110*m* is turned on, the M-developing unit 4*m* is rotated through an output shaft 111*m*, an output gear 112*m* and a sleeve gear 113*m*. Similarly, when a C-clutch 110*c* is turned on, the C-developing unit 4*c* is rotated through an output shaft 111*c*, an output gear 112*c* and a sleeve gear 113*c*. When a Y-clutch 110*y* is turned on, the Y-developing unit 4*y* is rotated through an output shaft 111*y*, an output gear 112*y* and a sleeve gear 113*y*. When a Bk-clutch 110Bk is turned on, the Bk-developing unit 4Bk is rotated through an output shaft 111Bk, an output gear 112Bk and a sleeve gear 113Bk. A pair of supporting plates 114 and 115 supports the input shaft 103 and the output shafts 111*m*, 111*c*, 111*y* and 111Bk rotatably.

The operations of the pressure of each of the developing units 4*y*, 4*c*, 4*m* and 4Bk, clutching timing and the like will be described.

The operations will be described with reference to the timing charts of FIG. 7, FIG. 8 and FIG. 9. Hereupon, concrete numerical values are set for making the descriptions of the operations easy to understand. Incidentally, the numerical values are for the sake of reference, and the related art is not restricted to the numerical values.

The diameter of the photosensitive drum 1 is set at 180 mm, and the peripheral speed (or the image-forming process speed) of the photosensitive drum 1 is set at 200 mm/sec. The developing units 4*y*, 4*c*, 4*m* and 4Bk are disposed around the photosensitive drum 1 within an angular range of 0 degrees to 100 degrees with respect to a horizontal direction in the clockwise direction equidistantly (at the interval of 33.3 degrees) in the order of yellow (Y), cyan (C), magenta (M) and black (Bk). The order of developing is M, C, Y and Bk.

A case where an image of the A-4 size is continuously copied in a full color copying mode will be described.

Abscissa axes of the timing charts shown in FIG. 7 to FIG. 9 indicate time (or distance). FIG. 9 is an enlarged view of the M-developing operation shown in FIG. 7 and FIG. 8. The waveforms in the top row to the third row in FIGS. 7 and 8 indicate latent images on the photosensitive drum 1 at the M-developing position, the pressuring operation of the M-developing unit 4*m* to the latent images, and the on-off actions of the M-clutch 110*m*, respectively. Because the latent images for two prints are formed on the photosensitive drum 1 during the rotation of the photosensitive drum 1 in the A-4 continuous copying mode, a reference mark M1 designates a latent image of magenta in the copy on the first sheet, and a reference mark M2 designates a latent image of magenta in the copy on the second sheet.

Similarly, the waveforms in the fourth row to the sixth row in FIG. 7 indicate latent images on the photosensitive drum 1 at the C-developing position, the pressuring operation of the C-developing unit 4*c*, and the actions of the C-clutch 110*c*, respectively. The waveforms in the seventh row to the ninth row in FIG. 7 indicate latent images on the photosensitive drum 1 at the Y-developing position, the pressuring operation of the Y-developing unit 4*y*, and the actions of the Y-clutch 110*y*, respectively. The waveforms in the tenth row to the twelfth row in FIG. 7 indicate latent images on the photosensitive drum 1 at the Bk-developing position, the pressuring operation of the Bk-developing unit 4Bk, and the actions of the Bk-clutch 110Bk, respectively.

The formation of the latent images is started. The latent image of each color is equidistantly formed on the outer periphery of the photosensitive drum 1 having the diameter of 180 mm for two prints of the A-4 size. Because the length of the outer periphery of the photosensitive drum 1 is about 565.2 mm and the width of the A-4 size is 210 mm, the interval of the latent images is 72.6 mm from the calculation of: $(565.2-210\times2)\div2=72.6$ mm. The time of the interval of the latent images is 0.363 second from the calculation of: 72.6 (mm)÷200 (mm/second)=0.363 second.

The pressurization of the M-developing unit 4*m* to the photosensitive drum 1 is begun before 0.25 second short of (before 50 mm short of a position at) a point of time when the leading edge of the latent image M1 reaches the M-developing position. After 0.05 second (behind 10 mm) from the beginning of the pressure-contact of the M-developing unit 4*m* with the photosensitive drum 1, the M-clutch 110*m* is turned on as shown in FIG. 9. After 0.05 second (behind 10 mm) from the turning on of the M-clutch 10*m*, the peripheral speed of the M-developing unit 4*m* reaches a predetermined speed.

The development sleeve of the M-developing unit 4*m* is required to rotate at the predetermined peripheral speed before the completion of the pressure-contact of the development sleeve to the photosensitive drum 1. When the development sleeve does not rotate at the predetermined peripheral speed at the time of the pressure-contact thereof, there is a case where images are disturbed owing to the generation of "adherent fogging" being a phenomenon such that unnecessary toner adheres on the photosensitive drum 1.

After 0.15 second, or behind 30 mm, from the beginning of the pressure-contact of the M-developing unit 4*m* to the photosensitive drum 1, the pressure-contact of the M-developing unit 4*m* to the photosensitive drum 1 is completed. At this time, the development sleeve of the M-developing unit 4*m* rotates at the predetermined peripheral speed as described above.

Moreover, the M-developing unit 4*m* completes the pressure-contact to the photosensitive drum 1 with a clearance of the time of 0.1 second, or the distance of 20 mm, before the leading edge of the latent image M1. Then, the latent images M1 and M2 are developed.

After 0.1 second (behind 20 mm) from the completion of the development of the latent image M2, the M-developing unit 4*m* begins to separate from the photosensitive drum 1. The development sleeve of the M-developing unit 4*m* is also required to rotate at the predetermined peripheral speed when the M-developing unit 4*m* separates from the photosensitive drum 1 similarly at the time of the pressure-contact thereof. When the development sleeve is not rotating at the predetermined peripheral speed, the "fogging" is generated. In this case, when the M-developing unit 4*m* separates from the photosensitive drum 1, the M-clutch 110*m* is in a turned-on state thereof. Consequently, the "fogging" is not generated. After 0.05 second (behind 10 mm) from the beginning of the separation of the M-developing unit 4*m*, the M-clutch 110*m* turns off.

After 0.05 second (behind 10 mm) from the turning off of the M-clutch 110*m*, the M-developing unit 4*m* completely stops.

After 0.15 second (behind 30 mm) from the beginning of the separation operation of the M-developing unit 4*m*, the separation operation thereof is completed. The separation operation should be completed before the arrival of the next latent image C1 at the M-developing position. When the separation operation is not completed at the time of the arrival of the next latent image C1, there is the possibility that the latent image C1 of cyan is developed by the M-developing unit 4*m*.

In this example, the separation is completed with a clearance of the time of 0.113 second (a clearance of the distance of 22.6 mm) before the leading edge of the latent image C1 of cyan.

Next, the operation of the C-developing unit 4*c* will be described.

The C-developing unit 4*c* is disposed upstream of the M-developing unit 4*m* by the 33.3 degrees in the rotational direction of the photosensitive drum 1. Consequently, a latent image on the photosensitive drum 1 arrives at the C-developing position earlier than the arrival thereof at the M-developing position by the distance of: $180\times\pi\times(33\div360)=51.81$ mm≈52 mm, namely by the time of: $51.81\div200=0.259$ second≈0.26 second. Because the timing charts shown in FIG. 7 and FIG. 8 are drawn by the use of the same time axes, the latent images at the C-developing position are shifted to the left side in the timing chart of FIG. 7 by the 0.26 second (by the 52 mm).

The operation of the C-developing unit 4*c* is similar to that of the M-developing unit 4*m*.

After 0.113 second (behind 22.6 mm) from the passing through of the trailing edge of the latent image M2 at the C-developing position, the pressure-contact of the C-developing unit 4*c* to the photosensitive drum 1 is begun. After 0.05 second (behind 10 mm) from the beginning of the pressure-contact of the C-developing unit 4*c* to the photosensitive drum 1, the C-clutch 110*c* turns on.

After 0.05 second (behind 10 mm) from the turning on of the C-clutch 110*c*, the peripheral speed of the C-developing unit 4*c* reaches the predetermined peripheral speed. After 0.15 second (behind 30 mm) from the beginning of the pressure-contact of the C-developing unit 4*c* to the photosensitive drum 1, the pressure-contact of the C-developing unit 4*c* to the photosensitive drum 1 is completed. At this time, the C-developing unit 4*c* has reached the predetermined peripheral speed, and the pressure-contact of the C-developing unit 4*c* is completed with a clearance of the time of 0.1 second (the clearance of the distance of 20 mm) before the leading edge of the latent image C1. Then the latent image C1 and a latent image C2 are developed.

After 0.1 second (behind 20 mm) from the completion of the development of the latent image C2, the C-developing unit 4*c* begins to separate from the photosensitive drum 1.

After 0.05 second (behind 10 mm) from the beginning of the separation of the C-developing unit 4*c*, the C-clutch 110*c* turns off. After 0.05 second (behind 10 mm) from the turning off of the C-clutch 110*c*, the C-developing unit 4*c* completely stops.

After 0.15 second (behind 30 mm) from the beginning of the separation operation of the C-developing unit 4*c*, the C-developing unit 4*c* completes its separation operation. At this time, the separation of the C-developing unit 4*c* is completed with a clearance of the time of 0.113 second (a clearance of the distance of 22.6 mm) to the leading edge of the following latent image Y1.

Similarly, the Y-developing unit 4*y* is disposed upstream of the C-developing unit 4*c* by the 33.3 degrees in the rotational direction of the photosensitive drum 1. Consequently, latent images at the Y-developing position are shifted to the left side in the timing chart of FIG. 7 by the 0.261 second (by the 52 mm).

The operation of the Y-developing unit 4*y* is similar to those of the M-developing unit 4*m* and the C-developing unit 4*c*.

Moreover, the Bk-developing unit 4Bk is disposed downstream of the Y-developing unit 4*y* by the 100 degrees in the rotational direction of the photosensitive drum 1. Consequently, latent images at the Bk-developing position are shifted to the right side in the timing chart of FIG. 8 by the amount of: $180\times\pi\times(100\div360)=157$ mm, or the amount of: $157\div200=0.785$ second.

The operation of the Bk-developing unit 4Bk is similar to those of the M-developing unit 4*m*, the C-developing unit 4*c* and the Y-developing unit 4*y*. Moreover, because the M-developing unit 4*m* is disposed upstream of the Bk-developing unit 4Bk by the 33 degrees in the rotational direction of the photosensitive drum 1, the latent images at the M-developing position are shifted to the left side by the 0.261 second (by the 52 mm) in the timing chart of FIG. 8 with respect to the latent images at the Bk-developing position.

After that, the aforesaid operations are repeated with keeping the aforesaid relations.

However, the following disadvantages have been produced in the aforesaid related art configuration at some timing between the transmission of the driving of each of the developing units 4*y*, 4*c*, 4*m* and 4Bk.

Although the operation of each of the developing units 4*y*, 4*c*, 4*m* and 4Bk is performed as described above, the relations between each of the developing units 4*y*, 4*c*, 4*m* and 4Bk are now noticed. The timing of the turning on of the C-clutch 110*c* will be described. Immediately before the turning on of the C-clutch 110*c*, the M-developing unit 4*m* is in a state of pressure-contact, and the M-clutch 110*m* is in its turned-on state and the latent image M2 is being developed. FIG. 6 is referred while the following description is made. Driving from a drive motor (not shown) is transmitted to the timing belt 101, the input pulley 102, the input shaft 103, the distributing gear 104, the M-clutch gear 109*m*, the M-clutch 110*m*, the output shaft 111*m*, the output gear 112*m* and the sleeve gear 113*m* in the order, and thereby the drive motor drives the M-developing unit 4*m* to rotate it. In such a state, when the C-clutch 110*c* is turned on, the driving from the distributing gear 104 is transmitted to the C-clutch gear 109*c*, the C-clutch 110*c*, the output shaft 111*c*, the output gear 112*c*, and the sleeve gear 113*c* in the order. Then, the driving is to drive the C-developing unit 4*c* to rotate it.

At this time, the load and the inertia of the C-developing unit 4*c* are transmitted to the distributing gear 104 through the reverse path of the path at the time of the transmission of driving, and the transmitted load and the transmitted inertia instantaneously lowers the rotational speed of the distributing gear 104.

The lowering of the rotational speed of the distributing gear 104 is transmitted to the M-clutch gear 109*m*, the M-clutch 110*m*, the output shaft 111*m*, the output gear 112*m* and the sleeve gear 113*m* in the order. Finally, the speed of the M-developing unit 4*m* is lowered.

The M-developing unit 4*m* is developing the position thereof before 0.098 second (before 19.6 mm) from the trailing edge of the latent image M2 at this time. Consequently, when the rotational speed of the development sleeve of the M-developing unit 4*m* is lowered, the feeding of toner to the latent image M2 becomes uneven, and unevenness in a shape of lateral strips are produced at the corresponding positions on an image.

These disadvantages are not limited to the relations between the M-developing unit 4*m* and the C-developing unit 4*c*, and they are generated in any timing of the transmission of driving to one developing unit during the developing of a latent image by another developing unit.

In the C-developing unit 4*c*, the lowering of the rotational speed during the development of the trailing edge of the latent image C2 owing to the turn on of the Y-clutch 110*y* is produced at a time designated by a reference numeral (i) in FIG. 7 to generate lateral stripes. In the Bk-developing unit 4Bk, the lowering of the rotational speed during the development of the trailing edge of the latent image Bk2 owing to the turn on of the M-clutch 110*m* is produced at a time designated by a reference numeral (ii) in FIG. 8 to generate lateral stripes.

Because the developing positions of the Y-developing unit 4*y* and the Bk-developing unit 4Bk are sufficiently distant and there is no timing when two color clutches of the Y-clutch 110*y* and the Bk-clutch 110Bk are in their turned-on states at the same time between the Y-developing unit 4*y* and the Bk-developing unit 4Bk, no disadvantage such that the lateral stripes are produced is presented.

Accordingly, it is considerable that the diameter of the photosensitive drum 1 is enlarged to widen the intervals between latent images so that the lateral stripes are not produced. However, in this case, another problem such that the shape of the apparatus becomes large is presented.

Moreover, it is also considerable to thin out the rotations of the photosensitive drum 1 by a half rotation thereof to form the next latent image C1 after the formation of the latent images M1 and M2 (i.e. the latent image C1 in the related art is not formed, and the latent image C1 is formed at the position of the latent image C2 in the related art and the latent image C2 is formed at the position of the latent image Y1 in the related art). However, in this case, another problem such that the printing speed thereof decreases to the ⅔ of that of the related art is presented.

A method for performing the pressurization operation in the developing process and the clutch operations at high speeds would increase the shocks at the time of the pressurization to disturb the formation of latent images, and thereby image blurring would be caused. Besides, the necessity of the changes of the clutches 110*m*, 110*c*, 110*y* and 110Bk to be ones having a large capacity would be brought about, which would make the cost of the apparatus increase largely.

Anyway, for the escape of these disadvantages, it is necessary to employ a structure not to perform the transmission of driving to a developing unit while another developing unit is developing a latent image.

SUMMARY OF THE INVENTION

One object of the present invention is to provide a rotating force transmitting apparatus capable of preventing the occurrence of a phenomenon such that, when the rotation of one of a first and a second rotary members is begun while the other of them is rotating, the rotational speed of the rotating rotary member is decreased.

Another object of the present invention is to provide an image forming apparatus capable of preventing the occurrence of the phenomenon such that, when the rotation of one of the first and the second rotary members is begun while the other of them is rotating, the rotational speed of the rotating rotary member is decreased.

A further object of the present invention is to provide an image forming apparatus capable of preventing a faulty image owing to the decrease of the rotational speed of a development rotary member to obtain a high quality image at a high printing speed without enlarging the shape of the apparatus and increasing the cost thereof.

The other objects, features and advantages of the present invention will become more apparent from the following description of the presently preferred exemplary embodiments of the invention taken in conjunction with the accompanying drawings.

DETAILED DESCRIPTION OF THE PREFERRED EMBODIMENTS

Preferred Embodiments of the present invention will be described with reference to the accompanying drawings.

(Image Forming Apparatus)

The main part of a full color electrostatic copying machine 200 being an example of an image forming apparatus will be described with reference to FIG. 1 and FIG. 2.

The full color electrostatic copying machine 200 is equipped with a color image reader portion (hereinafter referred to as a "reader portion") for reading image information on an original at the upper part thereof and a digital image printer portion (hereinafter referred to as a "printer portion") for recording an image on a recording medium on the basis of the image information from the reader portion at the lower part thereof.

Figure 1:
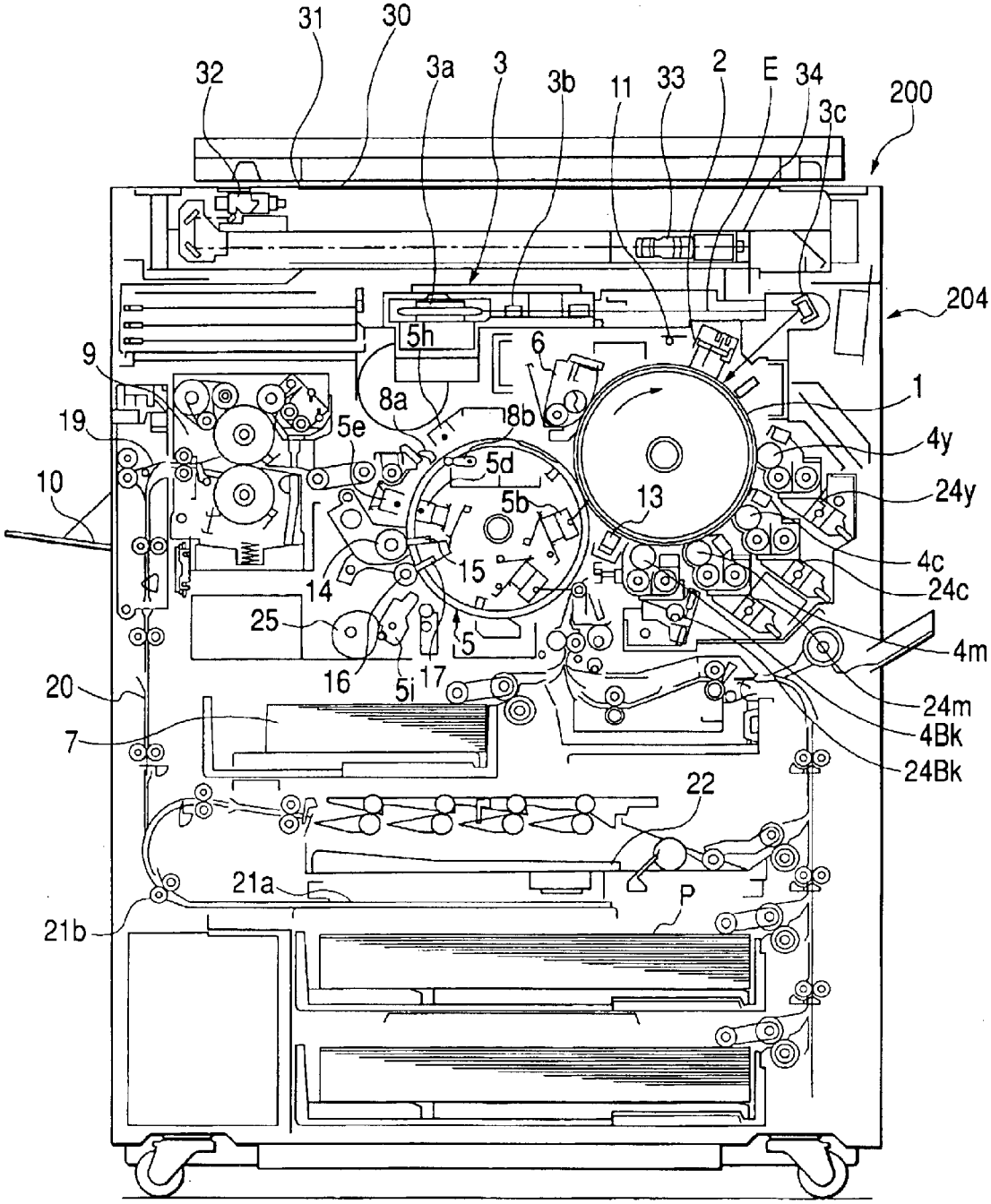
FIG. 1 is a schematic front sectional view of a full color electrostatic copying machine being an image forming apparatus equipped with a rotating force transmitting apparatus according to the present invention in the apparatus main body thereof.

As shown in FIG. 1, in the reader portion, an original 30 placed on an original glass stand 31 is exposed to be scanned by an exposure lamp 32, and a light image reflected by the original 30 is condensed by a lens 33. The condensed light beam reflected by the original 30 is obtained by a full color charge coupled device (CCD) sensor 34 as image signals separated into colors. The image signals separated into colors are transmitted to the printer portion after being processed by a video processing unit (not shown) through an amplifying circuit (not shown).

Figure 2:
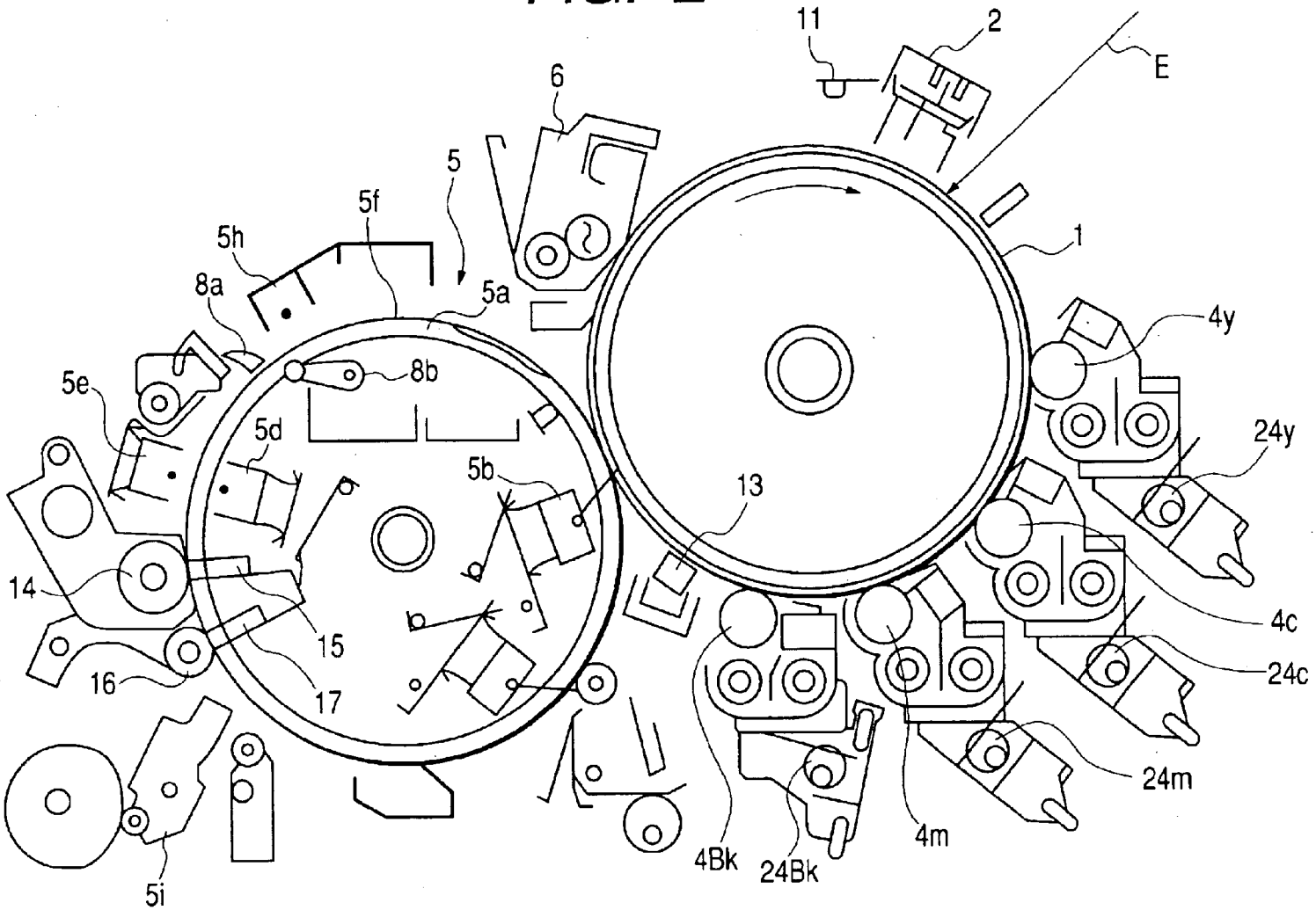
FIG. 2 is an enlarged view of the printer portion of the full color electrostatic copying machine of FIG. 1.

As shown in FIG. 1 and FIG. 2, the printer portion supports a photosensitive drum (image bearing member) 1 being an image bearing member rotatably in the direction indicated by the arrow. Around the photosensitive drum 1, a pre-exposure lamp 11, a corona charger 2, a laser exposure optical system 3, a Y-developing unit (development rotary member) 4*y*, a C-developing unit (development rotary member) 4*c*, an M-developing unit (development rotary member) 4*m* and a Bk-developing unit (development rotary member) 4Bk being four developing devices for different colors, means 13 for detecting a quantity of light on the photosensitive drum 1, a transferring apparatus 5, and a cleaning device 6 are disposed. Among these components, the photosensitive drum 1, the pre-exposure lamp 11, the corona charger 2, the laser exposure optical system 3, the four developing units 4*y*, 4*c*, 4*m* and 4Bk for different colors, and the like constitute image forming means. The Y-developing unit 4*y* is a developing unit for yellow. The C-developing unit 4*c* is a developing unit for cyan. The M-developing unit 4*m* is a developing unit for magenta. The Bk-developing unit 4Bk is a developing unit for black.

The laser exposure optical system 3 makes laser beam from a laser outputting portion (not shown) according to image signals from the reader portion reflect on a polygon mirror 3*a* to irradiate the photosensitive drum 1 through a lens 3*b* and a mirror 3*c*.

When an image is formed by the printer portion, the charger 2 uniformly charges the photosensitive drum 1 after the photosensitive drum 1 has rotated in the direction indicated by the arrow to eliminate residual charges on the outer periphery of the photosensitive dram 1 with the pre-exposure lamp 11. Then, latent images are formed on the photosensitive drum 1 by respective light images E of separated colors being irradiated on the photosensitive drum 1.

Figure 7:
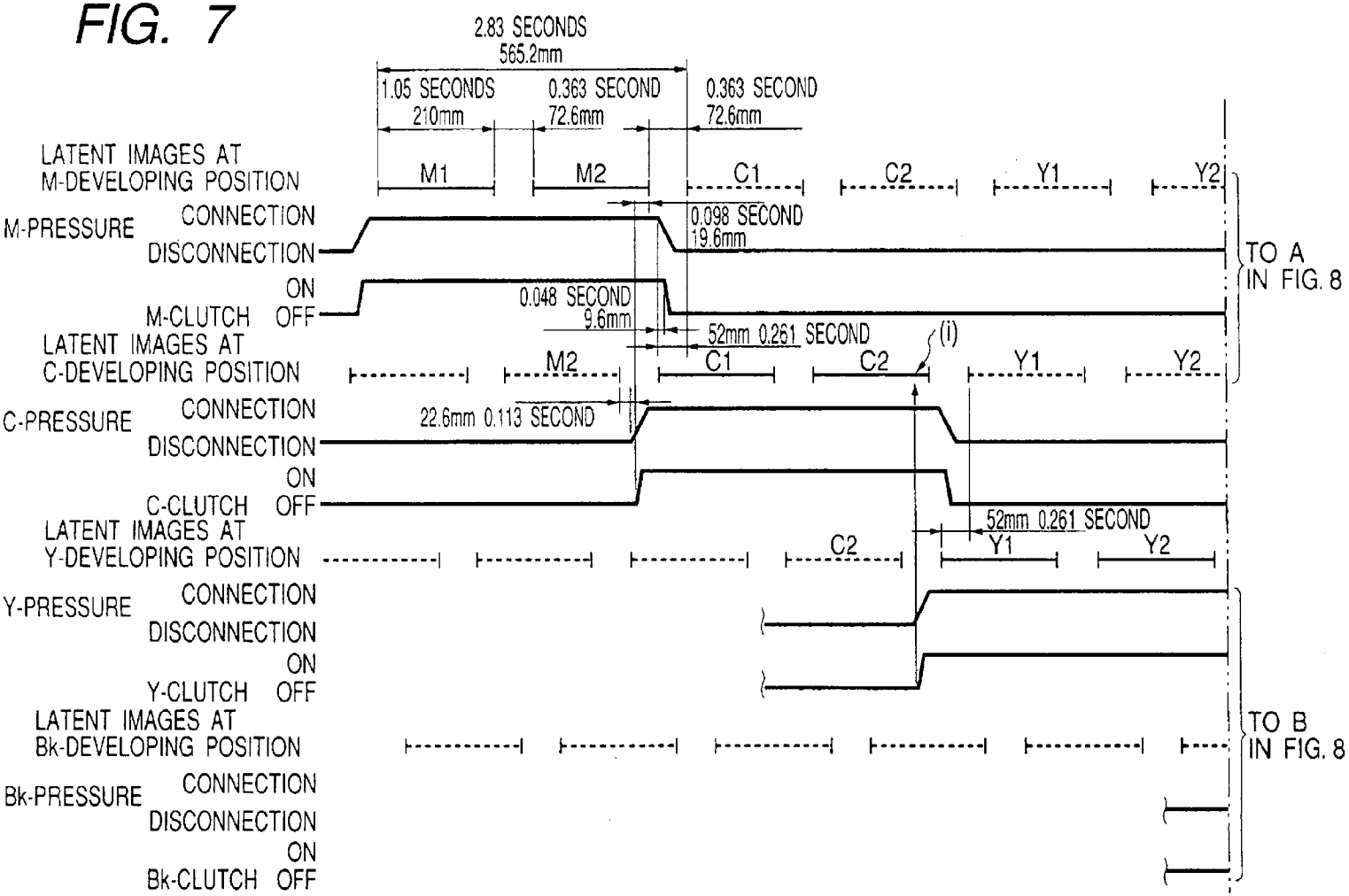
PRIOR ART FIG. 7
FIG. 7 is a part of a timing chart of the developing pressurization operations and the clutch operations of the conventional rotating force transmitting apparatus.
Figure 8:
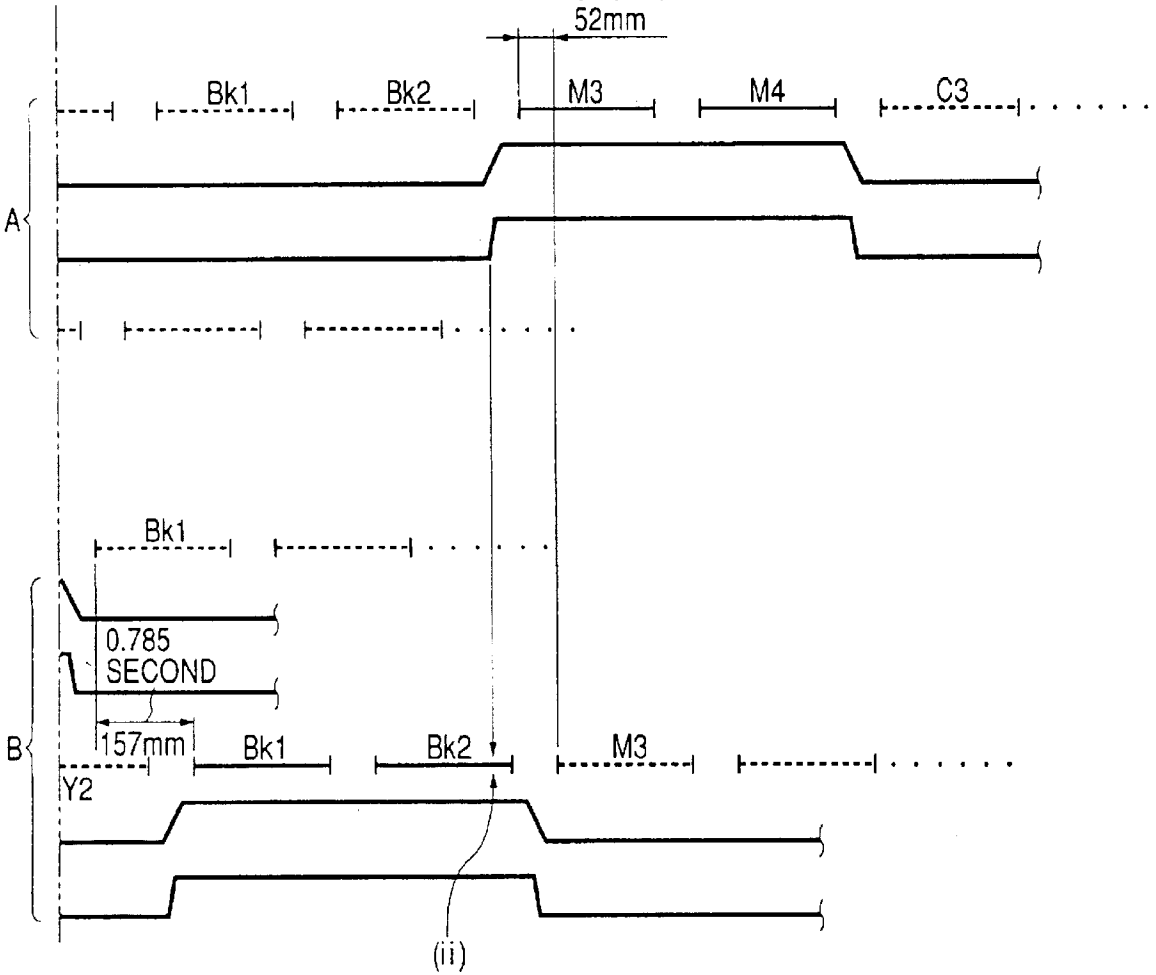
PRIOR ART FIG. 8
FIG. 8 is the other part of the timing chart of the developing pressurization operations and the clutch operations shown in FIG. 7, in which the waveforms indicated by reference characters A and B are succeeded by the waveforms indicated by the same reference characters A and B in FIG. 8.

Next, the latent images on the photosensitive drum 1 are developed by the operations of the developing units 4*y*, 4*c*, 4*m* and 4Bk corresponding to respective separated colors, and the images of toner being a powder developer having a base composed of a resin and a pigment are formed on the photosensitive drum 1. Incidentally, the developing units 4*y*, 4*c*, 4*m* and 4Bk are configured to approach the photosensitive drum 1 selectively in response to each separated color by the operations of respective eccentric cams 24*y*, 24*c*, 24*m* and 24Bk. Moreover, the order of forming images is in the order of M, C, Y and Bk as shown in FIG. 7 and FIG. 8.

On the other hand, a recording material being a recording medium contained in a recording-material cassette 7 is fed to a transferring portion formed between the photosensitive drum 1 and the transferring apparatus 5 by the conveying system, and the toner images on the photosensitive drum 1 are transferred onto the recording material by the transferring apparatus 5. Incidentally, the transferring apparatus 5 of the present image forming apparatus includes a transferring drum 5*a*, an inside charger 5*d* and an outside charger 5*e*. In an opening region on the peripheral surface of the transferring drum 5*a* supported to be driven to rotate, a recording material bearing sheet 5*f* made of a dielectric is formed to be spread integrally in a cylindrical shape. Moreover, in the present image forming apparatus, a dielectric sheet such as a polycarbonate film or the like is used as the recording material bearing sheet 5*f* being a part for bearing a recording material.

When the transferring apparatus 5 rotates the drum shaped transferring drum 5*a*, a transferring charger 5*b* transfers the toner images on the photosensitive drum 1 to the recording material borne by the recording material bearing sheet 5*f*. In such a way, on the recording material electrostatically attracted to the recording material bearing sheet 5*f* and conveyed by the recording material bearing sheet 5*f*, a desired number of color images are transferred to form a full color image.

The full color image forming apparatus separates the recording material from the transferring drum 5*a* with a separation claw 8*a*, a separation pushing up roller 8*b* and a separation charger 5*h* after the transferring of the four color toner images is completed. The fixing process for the recording material is performed by a heating roller fixing unit 9, and the recording material is delivered to a delivery tray 10.

On the other hand, after the transferring process, residual toner remaining on the surface of the photosensitive drum 1 is cleaned by the cleaning device 6 to be fed to the image forming process again.

Moreover, in the case where images are formed on both sides of the recording material, the recording material is once lead into a transferring path 21*a* through a vertical conveying path 20 by being driven by a conveying path switching guide 19 after the fixing process of the recording material has performed through the fixing unit 9. After that, by the reverse rotation of a surface reverse roller 21*b*, the trailing edge of the recording material at the time of being fed is turned to be in the lead, and the turned recording material is withdrawn in the opposite direction to the fed direction to be contained in an intermediate tray 22. Then, images are again formed on the other surface of the recording material by the aforesaid image forming process.

Incidentally, the present image forming apparatus is equipped with a backup brush 15 opposed to a fur brush 14 with the recording material bearing sheet 5*f* put between them and a backup brush 17 opposed to an oil eliminating roller 16 with the recording material bearing sheet 5*f* put between them for preventing the scattering and the attachment of a powder such as toner on the recording material bearing sheet 5*f* of the transferring drum 5*a*, the attachment of oil on the recording material, and the like. The cleaning of the recording material bearing sheet 5*f* is performed before or after the formation of images. At the time of jamming (the clogging of recording materials), the cleaning is performed whenever it is necessary.

Moreover, the present image forming apparatus is configured such that, when an eccentric cam 25 is operated at a desired timing, a cam follower 5*i* formed integrally with the transferring drum 5 is operated to set the gap between the recording material bearing sheet 5*f* and the photosensitive drum 1 arbitrarily. For example, the present image forming apparatus is configured such that, when it is in a standby state or the power source thereof is off, the transferring drum 5*a* and the photosensitive drum 1 can be separated.

(Rotating Force Transmitting Apparatus of First Embodiment)

Figure 3:
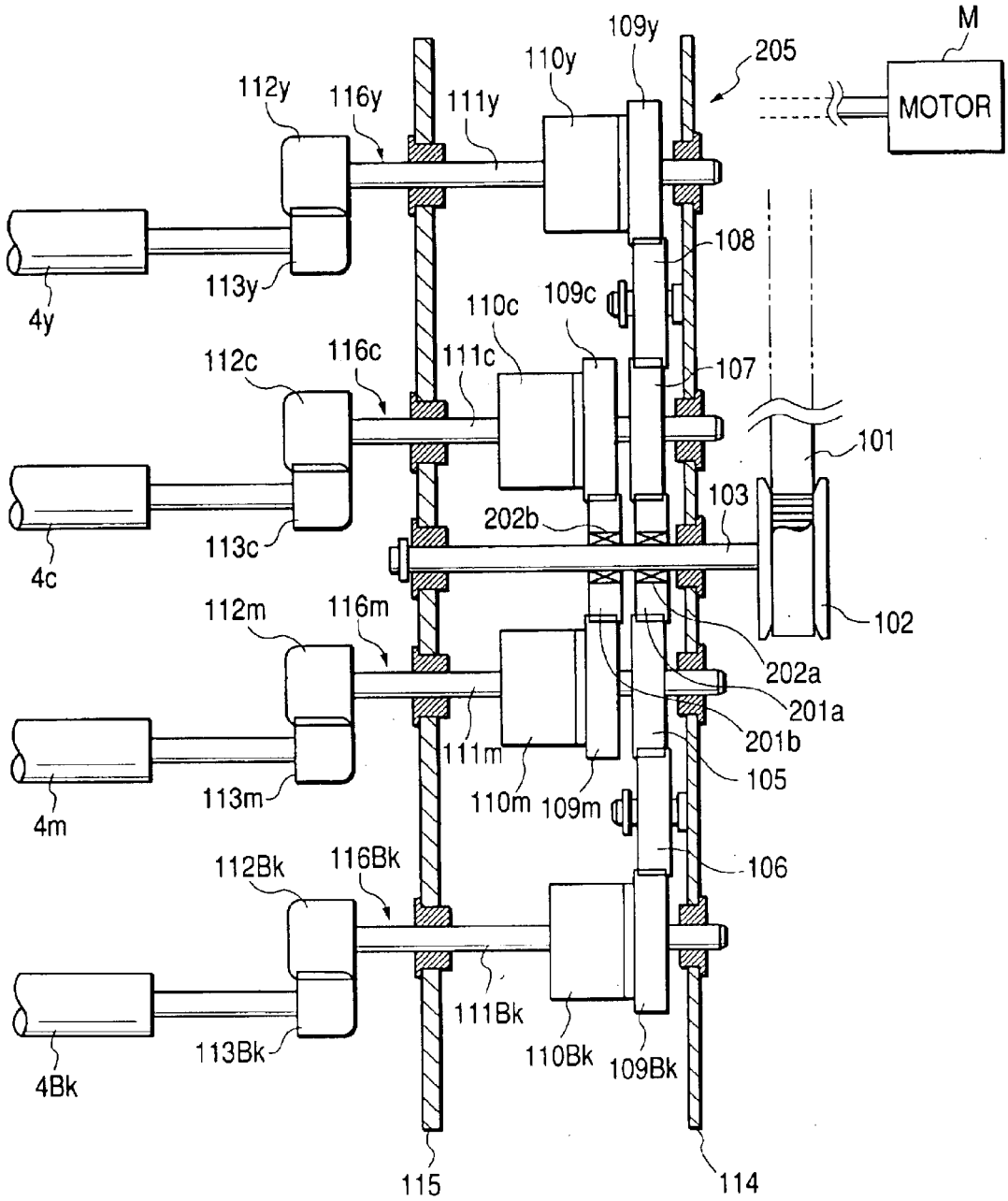
FIG. 3 is an expanded view of the rotating force transmitting apparatus of a first embodiment of the present invention.
Figure 9:
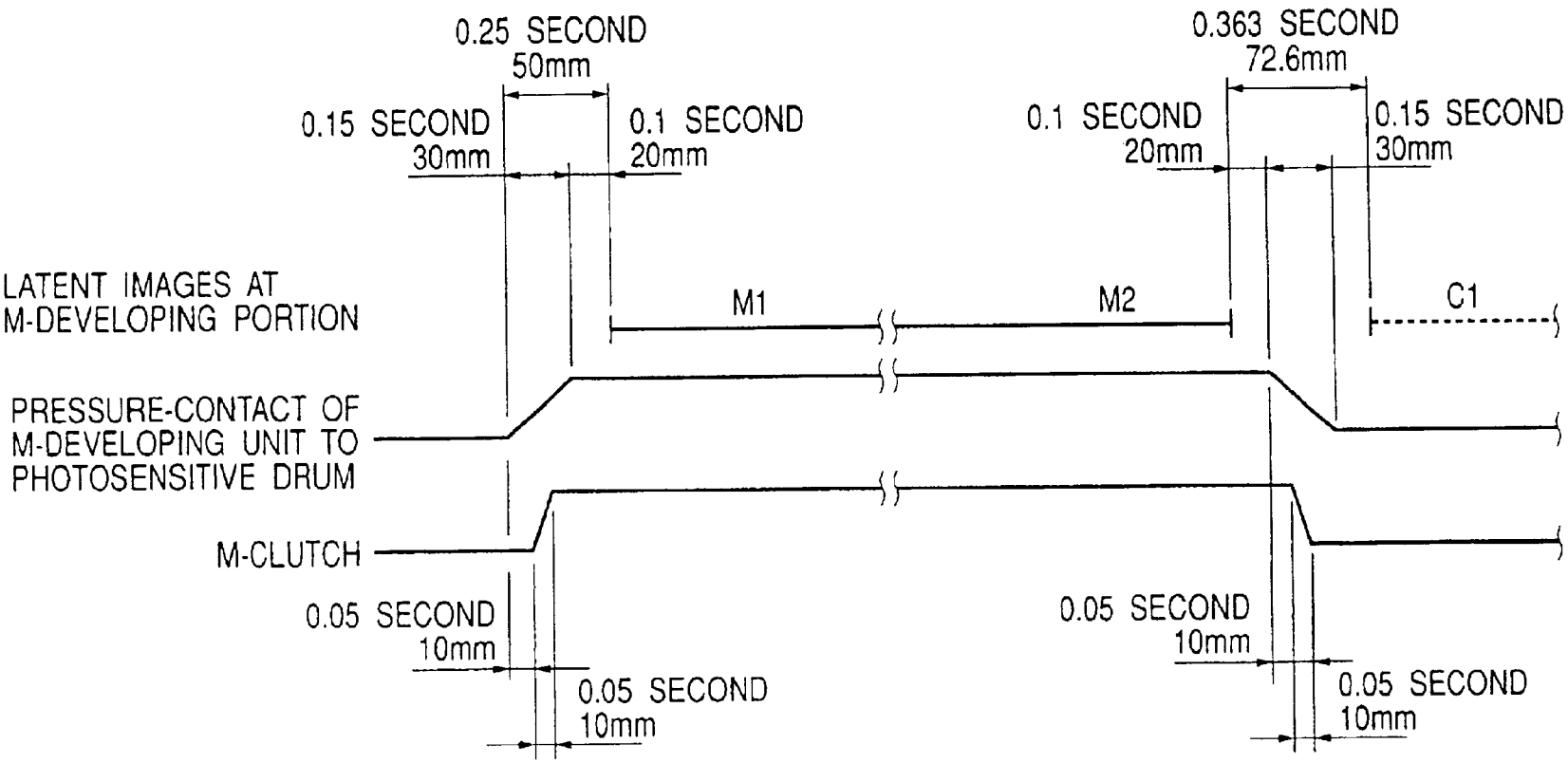
PRIOR ART FIG. 9
FIG. 9 is an enlarged view of a part of the waveforms in the timing chart of the developing pressurization operations and the clutch operations shown in FIG. 7.

FIG. 3 is an expanded view of a rotating force transmitting apparatus 205 provided in the apparatus main body 204 of the full color copying machine 200 as the image forming apparatus employing an electrophotographic process. Incidentally, the present embodiment employs the image forming sequence based on the aforesaid flow charts shown in FIG. 7 to FIG. 9. Moreover, the rotating force transmitting apparatus according to the first embodiment and a second embodiment of the preset invention can be used by being equipped in not only the apparatus main body 204 of the full color electrostatic copying machine 200 but also the other image forming apparatuses such as a printer and the like.

In FIG. 3, a rotating force is transmitted from a common drive motor M (driving means) to an input pulley 102 (driving means) being a common driving rotary member, and an input shaft 103 (driving means) being a driving rotation shaft by a timing belt 101 (driving means).

One-way clutches (such as overrunning clutches, for example, sprag clutches) 202*a* and 202*b* as one-way rotating force transmitting means (permitting means) are provided on the input shaft 103. The one-way clutches 202*a* and 202*b* are configured to have gears 201*a* and 201*b* on their outer peripheries. The locking directions of the gears 201*a* and 201*b* are set in the direction in which, when the input shaft 103 is rotated in the direction to rotate the developing units 4*y*, 4*c*, 4*m* and 4Bk in their normal directions, the shaft 103 and the gears 201*a* and 201*b* are locked to transmit the rotations of the shaft 103 to the gears 201*a* and 201*b*. When it is conversely expressed, the direction is the direction such that, when the gears 201*a* and 201*b* are rotated in the direction of driving the developing units 4*y*, 4*c*, 4*m* and 4Bk to rotate them in their normal direction, the gears 201*a* and 201*b* become free from the shaft 103.

A rotating force is transmitted from the input shaft 103 to the gears 201*a* and 201*b*. The rotations of the gear 201*a* are transmitted to a Bk-clutch gear 109Bk through idler gears 105 and 106, and are further transmitted to a Y-clutch gear 109*y* through idler gears 107 and 108.

The rotations of the gear 201*b* are transmitted to an M-clutch gear 109*m* and a C-clutch gear 109*c*. Now, when an M-clutch 110*m* is turned on (namely, an output shaft 111*m* and the M-clutch gear 109*m* are connected to each other for transmitting a driving force), the rotating force of the drive motor M is transmitted to the development sleeve (a rotary member) of the M-developing unit 4*m* through the gear 201*b*, the M-clutch 110*m*, the output shaft 111*m*, an output gear 112*m* and a sleeve gear 113*m* coaxial with the development sleeve as a development rotary member, and the development sleeve is rotated. Moreover, when the M-clutch 110*m* is turned off (namely, the connection between the output shaft 111*m* and the M-clutch gear 109*m* is released for releasing the transmission of the driving force), the transmission of the rotating force from the drive motor M to the development sleeve is disconnected. A C-clutch, a Y-clutch and a Bk-clutch that will be described later have the same configuration.

When the C-clutch 110*c* is turned on, the rotating force of the drive motor M is transmitted to the development sleeve of the C-developing unit 4*c* through the gear 201*b*, the C-clutch 110*c*, an output shaft 111*c*, an output gear 112*c* and a sleeve gear 113*c* coaxial with the development sleeve as a development rotary member, and the development sleeve is rotated.

When the Y-clutch 110*y* is turned on, the rotating force of the drive motor M is transmitted to the development sleeve of the Y-developing unit 4*y* through the gear 201*a*, the idle gears 107 and 108, the Y-clutch gear 109*y*, the Y-clutch 110*y*, an output shaft 111*y*, an output gear 112*y* and a sleeve gear 113*y* coaxial with the development sleeve as a development rotary member, and the development sleeve is rotated.

Then, when the Bk-clutch 110Bk is turned on, the rotating force of the drive motor M is transmitted to the development sleeve of the Bk-developing unit 4Bk through the gear 201*a*, the idle gears 105 and 106, the Bk-clutch gear 109Bk, the Bk-clutch 110Bk, an output shaft 111Bk, an output gear 112Bk and a sleeve gear 113Bk coaxial with the development sleeve as a development rotary member, and the development sleeve is rotated.

The operations of the rotating force transmitting apparatus 205 are described with the notice of the timing of the turning on of the Y-clutch 110*y* (for example, the timing at the position (i) in FIG. 7) while the C-developing unit 4*c* is performing development.

Immediately before the turning-on of the Y-clutch 110*y*, the C-developing unit 4*c* is in a state of pressure-contact, and the C-clutch 110*c* is in its turned-on state and a latent image C2 is being developed. That is, in FIG. 3, the drive motor M is rotating, and the rotations of the drive motor M are transmitted to the timing belt 101, the input pulley 102, the input shaft 103, the gear 201*b*, the C-clutch gear 109*c*, the C-clutch 110*c*, the output shaft 111*c*, the output gear 112*c* and the sleeve gear 113*c* in the order, and thereby the drive motor M drives the C-developing unit 4*c* to rotate it.

In such a state, when the Y-clutch 110*y* is turned on, the rotations from the gear 201*a* are transmitted to the idler gears 107 and 108, the Y-clutch gear 109*y*, the Y-clutch 110*y*, the output shaft 111*y*, the output gear 112*y*, and the sleeve gear 113*y* in the order. Then, the Y-developing unit 4*y* begins to rotate.

At this time, the load and the inertia of the Y-developing unit 4*y* are transmitted to the gear 201*a* and the input shaft 103 through the reverse path of the path at the time of the transmission of driving, and thereby the rotational speed of the input shaft 103 is instantaneously lowered. On the other hand, the rotational speed of the gear 201*b* remains the same so far owing to the inertia including the C-developing unit 4*c* on the downstream side. That is, the rotational speed of the gear 201*b* becomes faster than that of the input shaft 103.

At this time, the rotational direction of the gear 201*b* is directed to the direction permitting the preceding rotation of the C-developing unit 4*c* (or the direction in which the gear 201*b* becomes free from the input shaft 103). Consequently, sliding is generated between the input shaft 103 and the gear 201*b* by the one-way clutch 202*b*. Owing to the sliding, the decrease of the rotational speed of the C-developing unit 4*c*, which is performing development, is very little. After that, when the input shaft 103 returns to a predetermined speed, the gear 201*b* and the input shaft 103 enter in their locked states, and thereby rotations are transmitted.

As a result, the decrease of the rotational speed of the C-developing unit 4*c* is suppressed to a degree such that the feeding of toner to latent images is not influenced by that, and good images having no unevenness such as lateral stripes can be obtained.

The aforesaid operation is not limited to the relations between two colors of cyan (C) and yellow (Y). The operation can also be performed between the two colors of black (Bk) and magenta (M) similarly (for example, at the timing of (ii) in FIG. 8).

Because the image forming apparatus constructs the connection of the C-clutch 110*c* and the Y-clutch 110*y* through the gears 201*a* and 201*b*, and also the connection of the Bk-clutch 110Bk and the M-clutch 110*m* through the gears 201*a* and 201*b*, instantaneous decreases of speeds can be absorbed by the sliding of the one-way clutches 202*a* and 202*b* to obtain good images.

(Rotating Force Transmitting Apparatus of Second Embodiment)

The aforesaid rotating force transmitting apparatus 205 of the first embodiment does not cope with the decrease of the speed of the C-developing unit 4*c* owing to the turning-on of the C-clutch 110*c* of the C-developing unit 4*c* while the M-developing unit 4*m* is performing development. Accordingly, a rotating force transmitting apparatus 206 according to the second embodiment, which is shown in FIG. 4, is configured in order to deal with the decrease of the speed between the two colors.

Figure 4:
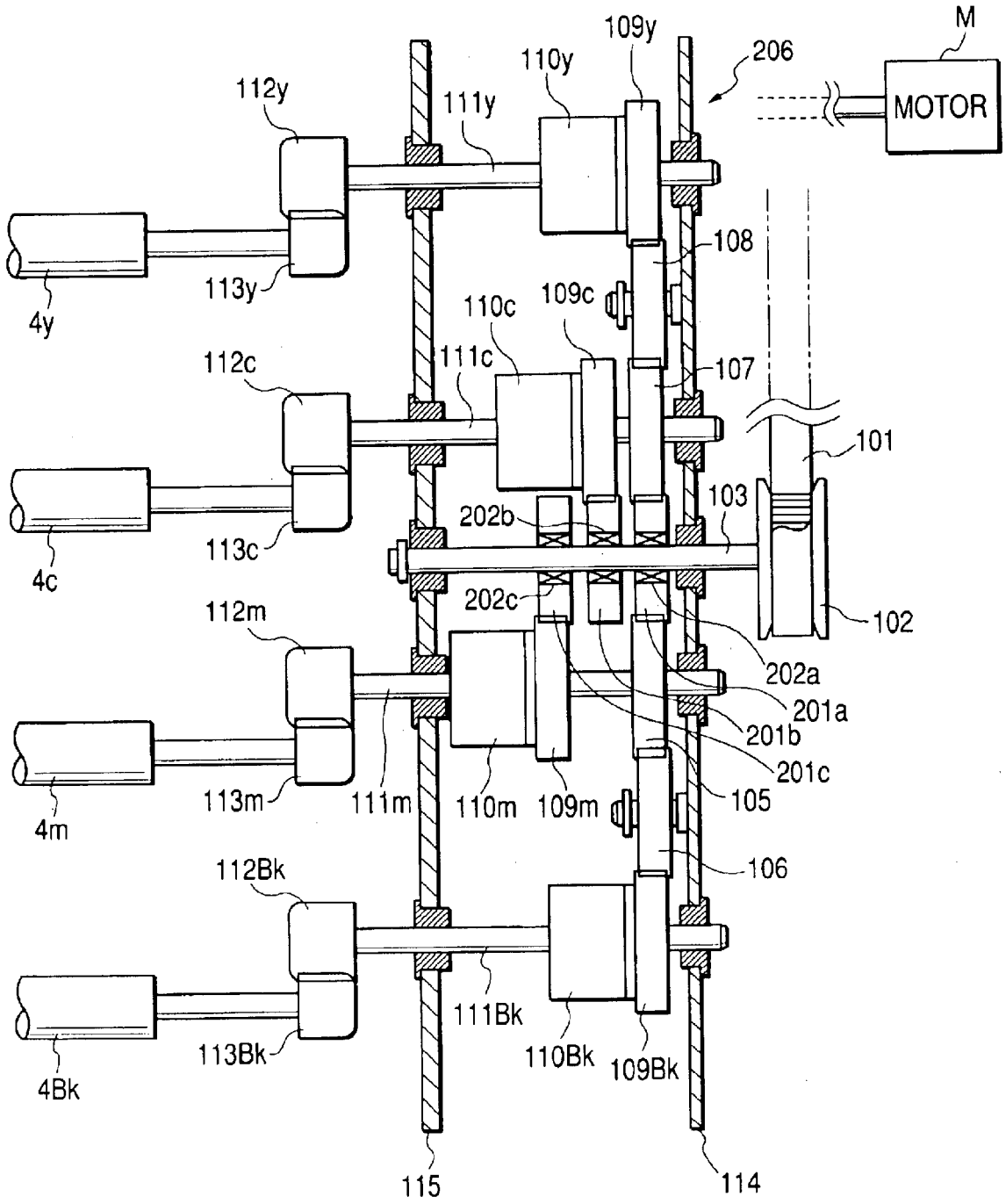
FIG. 4 is an expanded view of the rotating force transmitting apparatus of a second embodiment of the present invention.
Figure 5:
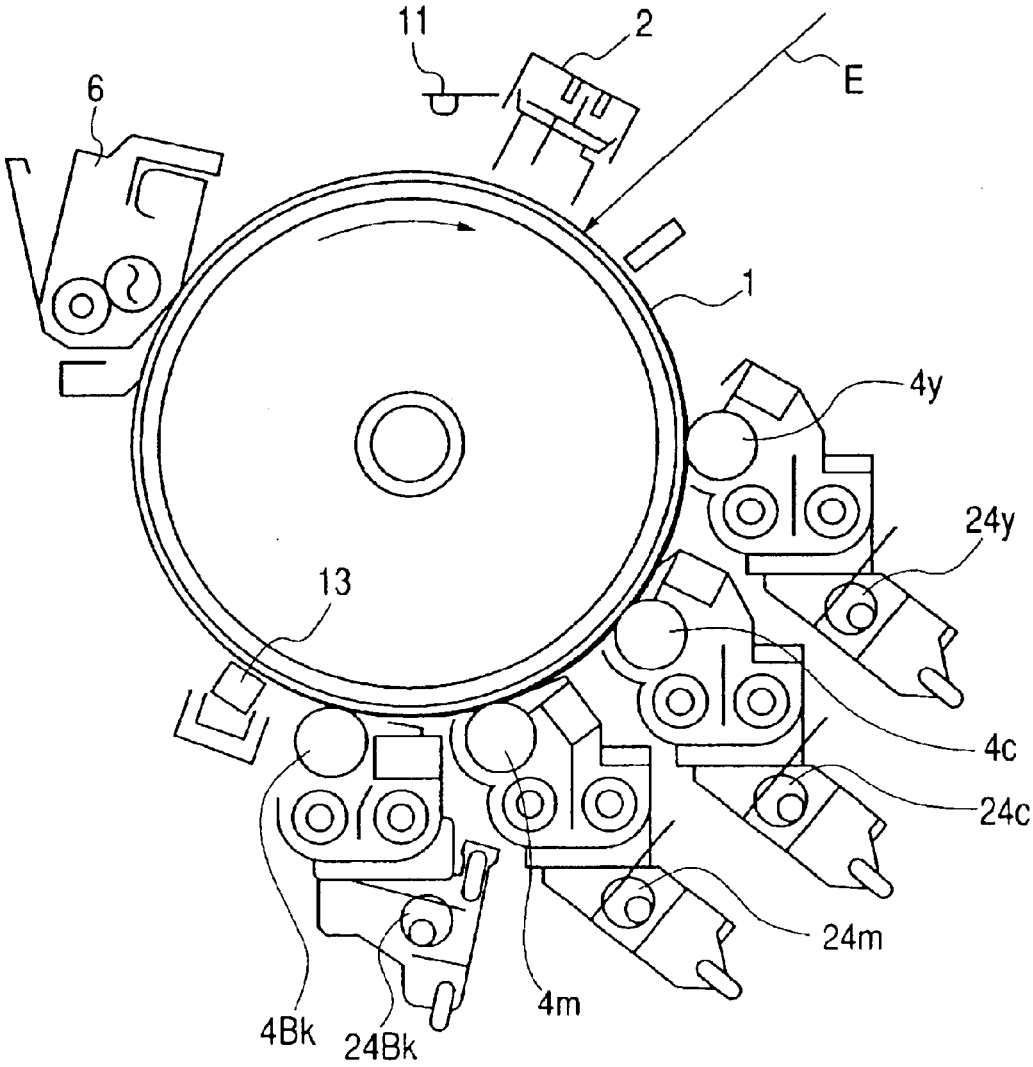
PRIOR ART FIG. 5
FIG. 5 is a schematic front view of the printer portion of a full color electrostatic copying machine being an image forming apparatus equipped with a conventional rotating force transmitting apparatus in the apparatus main body thereof.
Figure 6:
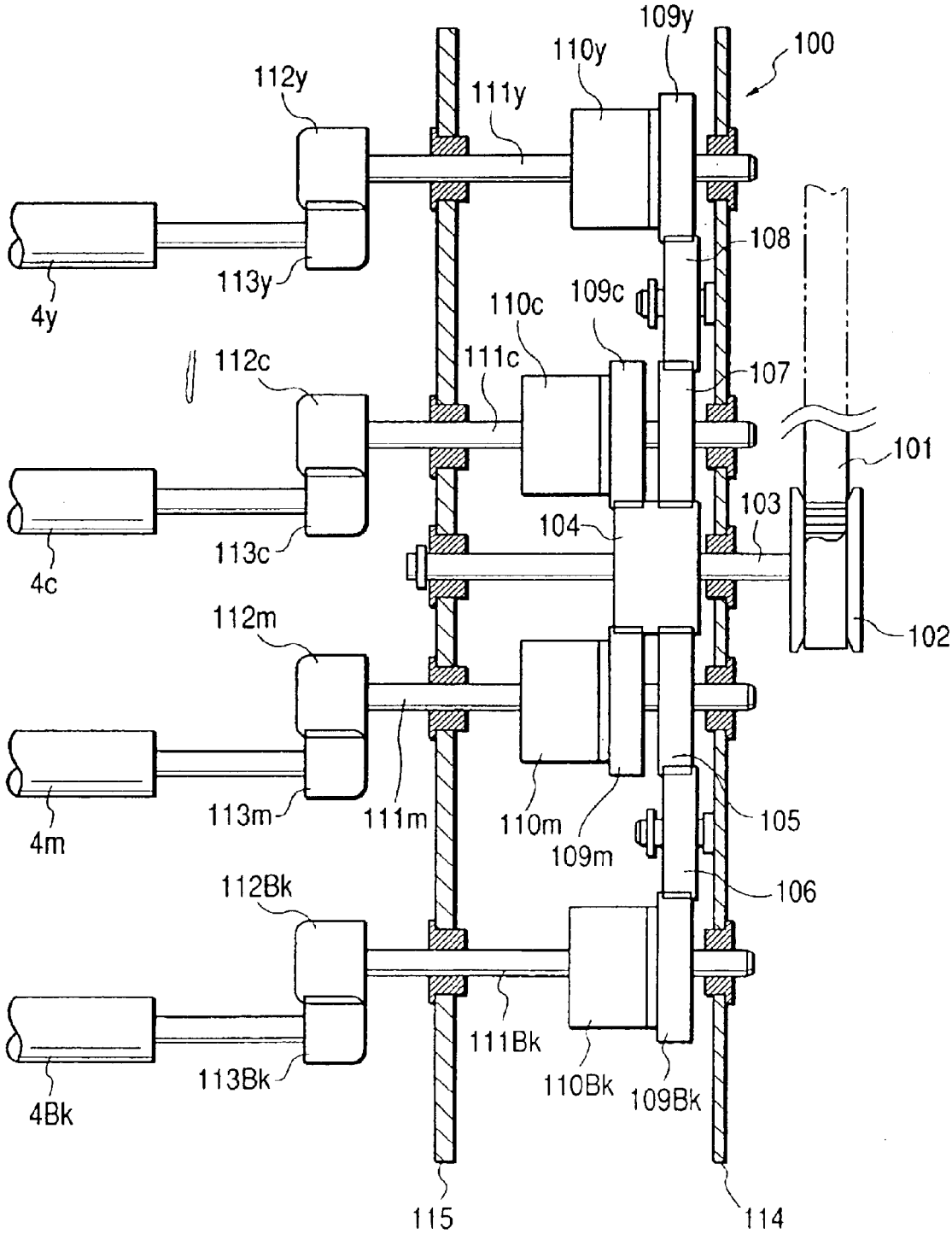
PRIOR ART FIG. 6
FIG. 6 is an expanded view of the conventional rotating force transmitting apparatus.

In FIG. 4, one-way clutches (one-direction rotating force transmitting means) 202*a*, 202*b* and 202*c* are provided on the input shaft 103, and gears 201*a*, 201*b* and 201*c* are provided on the outer peripheries of the one-way clutches 202*a*, 202*b* and 202*c*, respectively. The gear 201*a* transmits rotations of the drive motor M to the Y-developing unit 4*y* and the Bk-developing unit 4Bk. The gear 201*b* transmits rotations of the drive motor M to the C-developing unit 4*c*. The gear 201*c* transmits rotations of the drive motor M to the M-developing unit 4*m*.

The locking directions in the gears 201*a*, 201*b* and 201*c* are the same as those of the first embodiment. That is, the locking directions are the directions in which, when the developing units 4*y*, 4*c*, 4*m* and 4Bk are driven to rotate in their normal directions, the input shaft 103 is locked.

The operations of the rotating force transmitting apparatus 206 are described with the notice of the timing of the turning-on of the C-clutch 110*c* while the M-developing unit 4*m* is performing development.

Immediately before the turning-on of the C-clutch 110*c*, the M-developing unit 4*m* is in a state of pressure-contact, and the M-clutch 110*m* is in its turned-on state and a latent image M2 is being developed. In FIG. 4, the driving from the drive motor M is transmitted to the timing belt 101, the input pulley 102, the input shaft 103, the gear 201*c*, the M-clutch gear 109*m*, the M-clutch 110*m*, the output shaft 111*m*, the output gear 112*m* and the sleeve gear 113*m* in the order, and thereby the drive motor M drives the M-developing unit 4*m* to rotate it.

In such a state, when the C-clutch 110*c* is turned on, the driving from the gear 201*b* is transmitted to the C-clutch gear 109*c*, the C-clutch 110*c*, the output shaft 111*c*, the output gear 112*c*, and the sleeve gear 113*c* in the order. Then, the C-developing unit 4*c* is driven to rotate.

At this time, the load and the inertia of the C-developing unit 4*c* are transmitted from the gear 201*b* to the input shaft 103 through the reverse path of the path at the time of the transmission of driving, and thereby the rotational speed of the input shaft 103 is instantaneously lowered.

On the other hand, the rotational speed of the gear 201*c* remains the same so far (the speed during the development) owing to the inertia including the M-developing unit 4*m* on the downstream side.

That is, the rotational speed of the gear 201*c* becomes faster than that of the input shaft 103. At this time, the rotational direction of the gear 201*c* is directed to the direction permitting the preceding rotation of the M-developing unit 4*m* (or the direction in which the gear 201*c* becomes free from the input shaft 103). Consequently, sliding is generated between the input shaft 103 and the gear 201*c*. Owing to the sliding, the decrease of the rotational speed of the M-developing unit 4*m*, which is performing development, is very little. After that, when the input shaft 103 returns to a predetermined speed, the gear 201*c* and the input shaft 103 enter in their locked states again, and thereby the driving are transmitted.

As a result, the decrease of the rotational speed of the M-developing unit 4*m* is suppressed to a degree such that the feeding of toner to latent images is not influenced by that, and good images having no unevenness such as lateral stripes can be obtained.

The aforesaid operation is similarly performed between the two colors of cyan (C) and yellow (Y) (for example, at the position (i) in FIG. 7), and between the two colors of black (Bk) and magenta (M) (for example, at the position (ii) in FIG. 8).

Because the image forming apparatus constructs the connection of the M-clutch 110*m* and the C-clutch 110*c* through the gears 201*b* and 201*c*, and the connection of the C-clutch 110*c* and the Y-clutch 110*y* through the gears 201*a* and 201*b*, and further the connection of the Bk-clutch 110Bk and the M-clutch 110*m* through the gears 201*a* and 201*c*, instantaneous decreases of speeds can be absorbed by the sliding of the one-way clutches 202*a*, 202*b* and 202*c* to obtain good images.

Incidentally, because the Bk-developing unit 4Bk and the Y-developing unit 4*y* are distant from each other and the turning-on timing of the Bk-clutch 110Bk and turning-on timing of the Y-clutch 110*y* do not interfere to each other, the Bk-clutch gear 109Bk and the Y-clutch gear 109*y* are disposed in series. However, if the turning-on timing of the Bk-clutch 110Bk and turning-on timing of the Y-clutch 110*y* interfere to each other, a one-way clutch with a gear may be added by further shifting the driving systems in thrust directions.

As described above, according to the aforesaid embodiments, when the rotation of one development sleeve among a plurality of development sleeves as rotary members (development rotary members) is begun while another development sleeve is rotating for development, the disturbance (or the decrease) of the rotational speed of the development sleeve that has already been rotating owing to the beginning of the rotation of the development sleeve that is to be rotated afterward can be prevented, and the rotational speed of the development sleeve that has already been rotating can remains the same.

According to such an image forming apparatus, a high quality image without any inferior image quality (lateral stripes) owing to the speed changes of the development sleeves can be obtained at a high printing speed (image forming speed) without enlarging the size of the apparatus and increasing the costs thereof.

Although the invention has been described in a preferred form with a certain degree of particularity, obviously many changes and variations are possible therein. It is therefore to be understood that the present invention may be practiced in a manner other than as specifically described herein without departing from scope and the spirit thereof.

What is claimed is:

1. An image forming apparatus comprising:

first transmitting means for transmitting a rotating force to a first development rotary member wherein said first transmitting means includes a first clutch for intermittently transmitting the rotating force;

second transmitting means for transmitting the rotating force to a second development rotary member, wherein said second transmitting means includes a second clutch for intermittently transmitting the rotating force;

common driving means for imparting the rotating force to said first and said second transmitting means, wherein said second clutch can be switched from a turned-off state thereof to a turned-on state thereof for rotating said second development rotary member during a development operation in which said first development rotary member is rotating with said first clutch being turned on; and permitting means for permitting a transmission of the rotating force only in a normal rotational direction of said driving means to said first transmitting means.

2. An image forming apparatus according to claim 1, wherein said permitting means includes an overrunning clutch.

3. An image forming apparatus according to claim 2, wherein said overrunning clutch includes a gear rotatable only in the normal rotational direction.

4. An image forming apparatus according to claim 2 or 3, wherein said driving means includes a driving source, a drive rotation shaft provided with said overrunning clutch, and drive transmitting means for transmitting the rotating force of said driving source to said drive rotation shaft.

5. An image forming apparatus according to claim 1, wherein a commencement of a development operation of said second development rotary member is enabled during the development operation of said first development rotary member.

6. An image forming apparatus according to claim 5, wherein said first and said second development rotary members bear developers to convey the developers to respective developing positions.

7. An image forming apparatus according to claim 6, wherein said first and said second development rotary members execute the development operations on a common image bearing member.

8. A rotating force transmitting apparatus comprising:

first transmitting means or transmitting a rotating force to a first rotary member, wherein said first transmitting means includes a first clutch for intermittently transmitting the rotating force;

second transmitting means for transmitting the rotating force to a second rotary member, wherein said second transmitting means includes a second clutch for intermittently transmitting the rotating force;

common driving means or imparting the rotating force to said first and said second transmitting means, wherein said second clutch can be switched from a turned-off state thereof to a turned-on state thereof for rotating said second rotary member when said first rotary member is rotating with said first clutch being turned on; and permitting means for permitting a transmission of the rotating force only in a normal rotational direction of said driving means to said first transmitting means, wherein said permitting means includes an overrunning clutch provided with a gear rotatable only in the normal rotational direction.

9. A rotating force transmitting apparatus according to claim 8, wherein said driving means includes a driving source, a drive rotation shaft provided with said overrunning clutch, and drive transmitting means for transmitting a rotating force of said driving source to said drive rotation shaft.

* * * * *

UNITED STATES PATENT AND TRADEMARK OFFICE

CERTIFICATE OF CORRECTION

PATENT NO. : 6,778,798 B2
DATED : August 17, 2004
INVENTOR(S) : Makoto Kitahara

It is certified that error appears in the above-identified patent and that said Letters Patent is hereby corrected as shown below:

Title page,
Item [56], References Cited, FOREIGN PATENT DOCUMENTS,

| | | | | |
|---|---|---|---|---|
| "06003945 | 1/1994 | should read -- | 6-003945 | 1/1994 |
| 08277042 | 10/1996 | | 8-277042 | 10/1996 |
| 2000250315 | 9/2000" | | 2000-250315 | 9/2000 --. |

Column 2,
Line 14, "form" should read -- from --.

Column 13,
Lines 23 and 27, "to" should read -- with --; and
Line 40, "remains" should read -- remain --.

Column 14,
Lines 35 and 44, "or" should read -- for --.

Signed and Sealed this

Nineteenth Day of April, 2005

JON W. DUDAS
*Director of the United States Patent and Trademark Office*